US011326600B2

(12) United States Patent
Hattori et al.

(10) Patent No.: US 11,326,600 B2
(45) Date of Patent: May 10, 2022

(54) SCROLL TYPE COMPRESSOR

(71) Applicant: KABUSHIKI KAISHA TOYOTA JIDOSHOKKI, Kariya (JP)

(72) Inventors: Yuya Hattori, Aichi-ken (JP); Takuro Yamashita, Aichi-ken (JP); Takumi Maeda, Aichi-ken (JP); Shinji Koike, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 97 days.

(21) Appl. No.: 16/816,951

(22) Filed: Mar. 12, 2020

(65) Prior Publication Data

US 2020/0309126 A1 Oct. 1, 2020

(30) Foreign Application Priority Data

Mar. 28, 2019 (JP) ..... JP2019-063155

(51) Int. Cl.

| | |
|---|---|
| ***F04C 18/02*** | (2006.01) |
| ***F04C 27/00*** | (2006.01) |
| ***F04C 28/24*** | (2006.01) |
| ***F04C 29/12*** | (2006.01) |
| ***F04C 15/06*** | (2006.01) |
| ***F04C 23/00*** | (2006.01) |

(52) U.S. Cl.

CPC ..... *F04C 18/0215* (2013.01); *F04C 28/24* (2013.01)

(58) Field of Classification Search

CPC .. F04C 18/0215; F04C 18/0253; F04C 28/24; F04C 28/26; F04C 15/068; F04C 29/128; F04C 27/005

See application file for complete search history.

(56) References Cited

U.S. PATENT DOCUMENTS 4,958,993 A * 9/1990 Fujio ..... F04C 18/0215 418/55.3
5,674,058 A * 10/1997 Matsuda ..... F04C 28/16 417/440

(Continued)

FOREIGN PATENT DOCUMENTS

JP 2003-28079 A 1/2003
JP 2004353565 A * 12/2004 ..... F04C 29/00

(Continued)

OTHER PUBLICATIONS

English translation of JP-2004353565 by Espacenet 8/111/21.*

*Primary Examiner* — Deming Wan

(74) *Attorney, Agent, or Firm* — Sughrue Mion, PLLC

(57) ABSTRACT

A scroll type compressor includes a housing, a fixed scroll cooperating with the housing to define a discharge chamber, a movable scroll cooperating with the fixed scroll to define a compression chamber, and a shaft support member cooperating with the movable scroll to define a back pressure chamber. Fluid in the compression chamber is supplied to the back pressure chamber. The back pressure chamber and the discharge chamber communicate with each chamber through a relief passage. A check valve is disposed in the relief passage, and the check valve allows the fluid to flow from the back pressure chamber to the discharge chamber, when back pressure of the back pressure chamber is higher than discharge pressure of the discharge chamber.

6 Claims, 5 Drawing Sheets

(56) References Cited

U.S. PATENT DOCUMENTS

| | | | | |
|---|---|---|---|---|
| 2004/0253133 | A1* | 12/2004 | Gennami | F04C 18/0215 418/55.1 |
| 2011/0243777 | A1 | 10/2011 | Ito et al. | |
| 2015/0010417 | A1 | 1/2015 | Won et al. | |
| 2018/0087508 | A1 | 3/2018 | Tsubai et al. | |

FOREIGN PATENT DOCUMENTS

| | | | |
|---|---|---|---|
| JP | 2010-043598 | A | 2/2010 |
| JP | 2011-064189 | A | 3/2011 |
| KR | 10-2015-0004251 | A | 1/2015 |
| KR | 10-2018-0035699 | A | 4/2018 |

* cited by examiner

SCROLL TYPE COMPRESSOR

CROSS-REFERENCE TO RELATED APPLICATION

This application claims priority to Japanese Patent Application No. 2019-063155 filed on Mar. 28, 2019, the entire disclosure of which is incorporated herein by reference.

The present disclosure relates to a scroll type compressor.

BACKGROUND ART

Japanese Patent Application Publication No. 2011-64189 discloses a conventional scroll type compressor. The scroll type compressor includes a housing, a fixed scroll, a movable scroll, and a shaft support member. The fixed scroll is fixed to the housing. The fixed scroll and the housing cooperate to define a discharge chamber. The movable scroll is supported to be prevented from rotating and allowed to revolve around a revolution shaft of the movable scroll in the housing. The movable scroll and the fixed scroll cooperate to define a compression chamber. The shaft support member is fixed to the housing. The shaft support member and the movable scroll cooperate to define a back pressure chamber. In addition, the shaft support member and the housing cooperate to define a suction chamber. The scroll type compressor includes a motor mechanism configured to drive the movable scroll in the suction chamber. The fixed scroll has a base plate and a fixed scroll wall integrally formed with the base plate. The movable scroll has a scroll plate that faces the base plate and a movable scroll wall integrally formed with the scroll plate in engagement with the fixed scroll wall.

The movable scroll has a fluid supply passage configured of an inlet, an outlet, and a communication hole. The inlet opens at a front end face of the movable scroll wall and communicates with the compression chamber. The outlet opens at the scroll plate and communicates with the back pressure chamber. The inlet and the outlet communicate with each other through the communication hole. When the movable scroll deforms elastically or moves in an axial direction, the fluid supply passage provides communication between the compression chamber and the back pressure chamber. The back pressure chamber and the suction chamber communicate with each other through an extraction passage having a differential pressure control valve.

In the scroll type compressor, the movable scroll revolves by driving the motor mechanism compressing refrigerant gas as fluid in the compression chamber to a high pressure. The compressed refrigerant gas is discharged to the outside of the scroll type compressor through the discharge chamber. During this compression process, back pressure of the back pressure chamber is increased through fluid supply passage, urging the movable scroll toward the fixed scroll. This achieves high compression efficiency of the scroll type compressor. When back pressure of the back pressure chamber becomes excessively high, the differential pressure control valve of the extraction passage is opened by differential pressure between the back pressure of the back pressure chamber and suction pressure of the suction chamber. The refrigerant gas in the back pressure chamber flows to the suction chamber, preventing wear of the movable scroll caused by the excessively high back pressure.

However, the above conventional scroll type compressor is configured so as to open the differential pressure control valve of the extraction passage when back pressure of the back pressure chamber becomes excessively high. Fluid in the back pressure chamber flows into the suction chamber. With this configuration, the fluid that has been compressed is sucked into the compression chamber from the suction chamber and compressed again, causing power loss of the scroll type compressor.

The present disclosure has been made in view of the above circumstances and is directed to providing a scroll type compressor that prevents wear and the like of the movable scroll by excessively high back pressure while reducing power loss of the scroll type compressor.

SUMMARY

In accordance with an aspect of the present disclosure, there is provided a scroll type compressor that includes a housing, a fixed scroll fixed to the housing, and cooperating with the housing to define a discharge chamber, a movable scroll supported so as to be allowed to revolve around a revolution shaft in the housing, and cooperating with the fixed scroll to define a compression chamber, and a shaft support member fixed to the housing, cooperating with the movable scroll to define a back pressure chamber, and cooperating with the housing to define a suction chamber. The fixed scroll has a base plate and a fixed scroll wall integrally formed with the base plate. The movable scroll has a scroll plate facing the base plate and a movable scroll wall integrally formed with the scroll plate and engaging with the fixed scroll wall. Fluid in the compression chamber is supplied to the back pressure chamber, the back pressure chamber and the discharge chamber communicate with each other through a relief passage. A check valve is disposed in the relief passage, and the check valve allows the fluid to flow from the back pressure chamber to the discharge chamber, when back pressure of the back pressure chamber is higher than discharge pressure of the discharge chamber.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe a first embodiment to a fourth embodiment according to the present disclosure with reference to the accompany drawings.

(First Embodiment)

Figure 1:
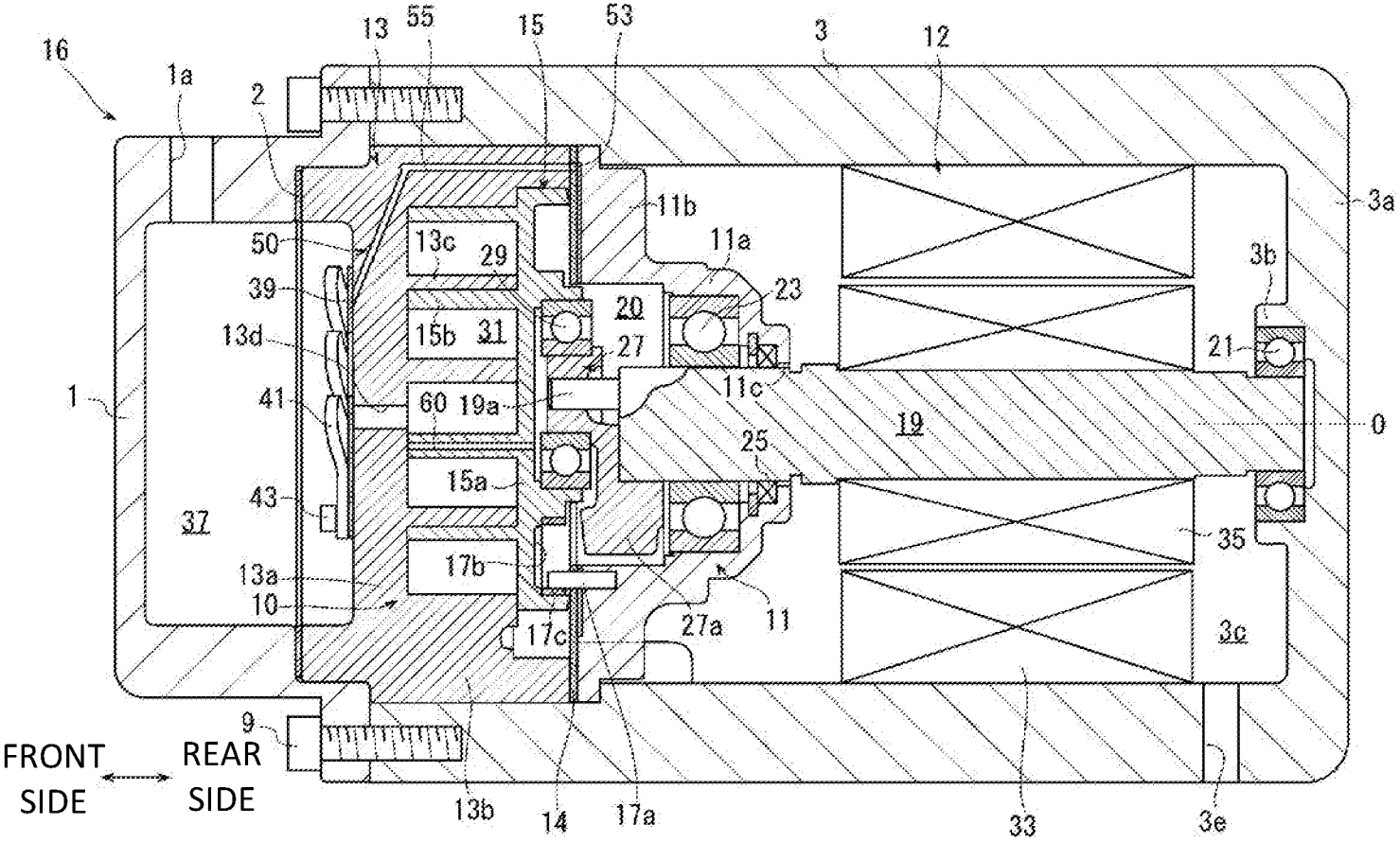
FIG. 1 is a longitudinal-sectional view of an electric compressor according to a first embodiment of the present disclosure.

A scroll type compressor of a first embodiment is an electric compressor, as shown in FIG. 1. The electric compressor includes a scroll type compression mechanism 10, a motor mechanism 12, and a housing 16. The housing 16 has a front housing 1 and a motor housing 3.

In the following description, a side near the front housing 1, that is, a left side of FIG. 1 is defined as a front side of the electric compressor. A side near the motor housing 3, that is, a right side of FIG. 1 is defined as a rear side of the electric compressor. The front and rear direction shown in FIG. 2 to FIG. 8 are each noted in accordance with the front and rear direction of FIG. 1. The front and rear direction of the first embodiment is an example. Generally speaking, a front and rear direction of an electric compressor is appropriately changed depending on a vehicle and the like, on which the electric compressor is mounted.

Referring to FIG. 1, the front housing 1 and the motor housing 3 are fixed by a plurality of bolts 9 so as to abut with each other at their edges. The motor housing 3 is formed in a bottomed cylindrical shape, and has an opening that opens near the front housing 1. The motor housing 3 has therein a fixed scroll 13, a plate 14, and a shaft support member 11, which are arranged in this order so that the fixed scroll 13 is on the front side of the scroll type compressor. The front housing 1 and the motor housing 3 cooperate to accommodate the fixed scroll 13, the plate 14, and the shaft support member 11 while being in contact with each other. In other words, the fixed scroll 13 and the shaft support member 11 are fixed to the housing 16 in this configuration. A gasket 2 is held between the fixed scroll 13 and the front housing 1.

The motor housing 3 has a bottom wall 3*a* and a cylindrical shaft support portion 3*b* extending forward from the bottom wall 3*a* in the center of an inner surface of the bottom wall 3*a*. The shaft support member 11 has a cylindrical main body 11*a* and a flange portion 11*b* protruding outward from an opening edge of a front end of the main body 11*a*. The main body 11*a* has through the center thereof a shaft hole 11*c*. The flange portion 11*b* is fixed to an inner peripheral surface of the motor housing 3. The flange portion 11*b* has a rotation preventing pin 17*a* protruding forward from a front surface of the flange portion 11*b*. The rotation preventing pin 17*a* prevents a movable scroll 15 from rotating and allows the movable scroll 15 to revolve. The movable scroll 15 is described later in detail.

A rotary shaft 19 that extends in a front and rear direction is inserted through the shaft hole 11*c*. The rotary shaft 19 is rotatably supported by the shaft support member 11 and the shaft support portion 3*b* via radial bearings 23 and 21 at each end of the rotary shaft 19. A seal member 25 is provided on the rear side of the radial bearing 23 and seals a space between the shaft support member 11 and the rotary shaft 19.

Figure 2:
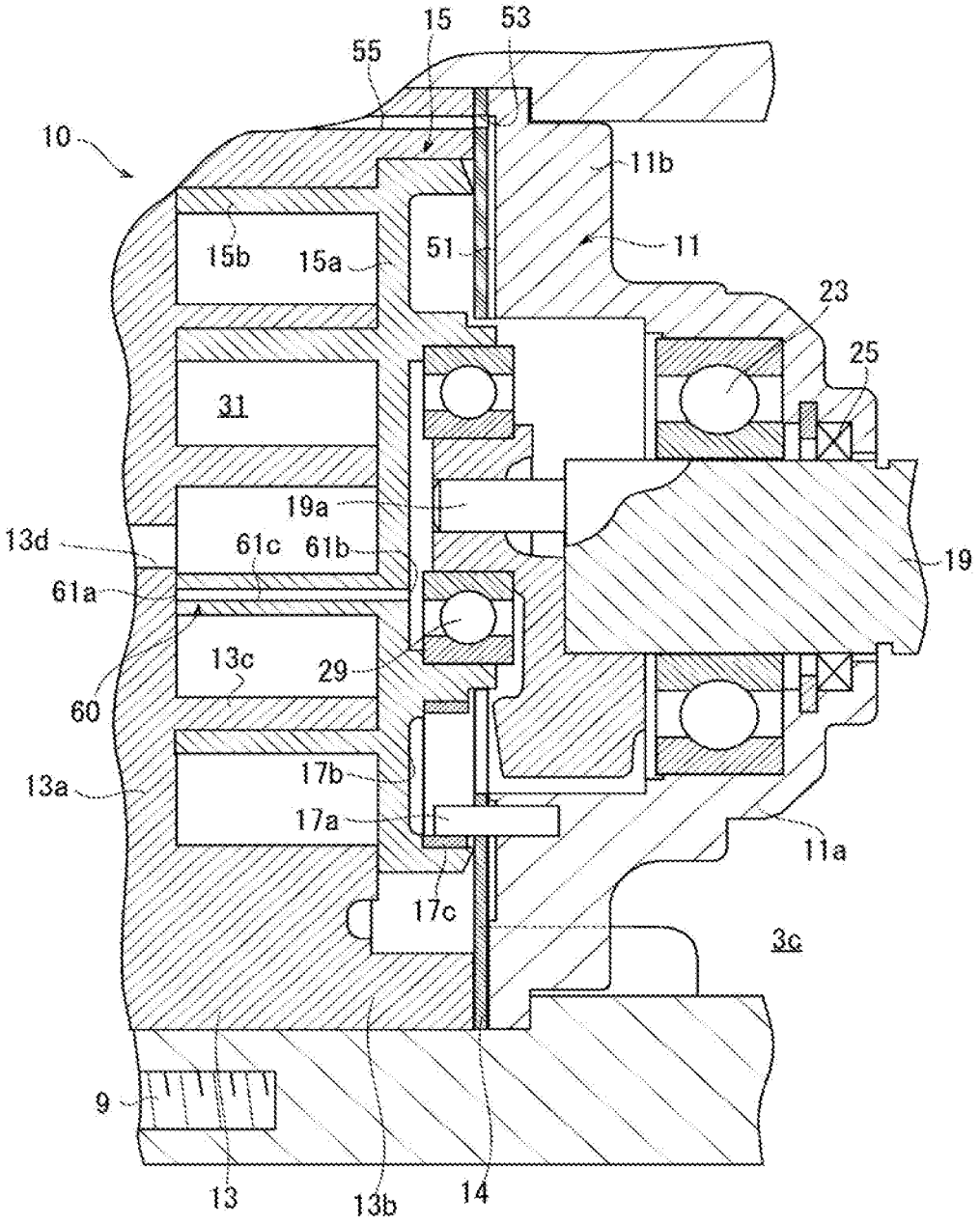
FIG. 2 is an enlarged cross-sectional view showing a main section of the electric compressor according to the first embodiment.
Figure 3:
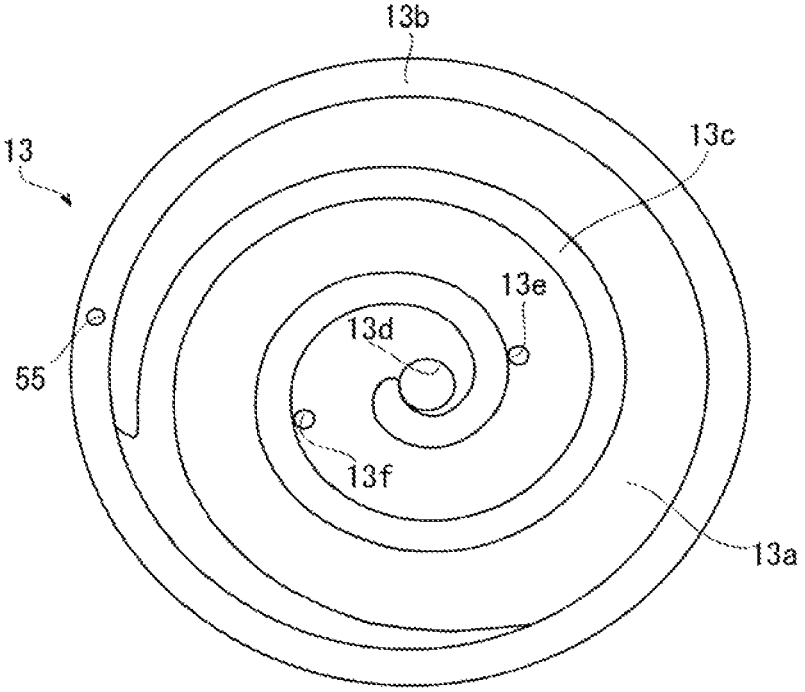
FIG. 3 is a plan view showing a front surface of a fixed scroll of the electric compressor according to the first embodiment.

Referring to FIG. 2, the rotary shaft 19 has a cylindrical eccentric pin 19*a* protruding from a front end of the rotary shaft 19. The eccentric pin 19*a* is located so as to be eccentric relative to a central axis O of the rotary shaft 19. The eccentric pin 19*a* supports a bush 27 in engagement with each other. A substantially half portion of an outer peripheral surface of the bush 27 is integrally formed with a balance weight 27*a* extending outward in a fan shape.

The fixed scroll 13 has a base plate 13*a*, a shell 13*b*, and a fixed scroll wall 13*c*. The base plate 13*a* has a circular plate shape so as to extend in a radial direction of the scroll type compressor. The shell 13*b* cylindrically extends rearward from an outer peripheral edge of the base plate 13*a*. The fixed scroll wall 13*c* is integrally formed with the base plate 13*a* and spirally extends rearward from the base plate 13*a* in the shell 13*b*. The shell 13*b* is thicker than the base plate 13*a* and the fixed scroll wall 13*c*. The shell 13*b* is formed so as to surround the fixed scroll wall 13*c*, and joined to the housing 16.

The movable scroll 15 is disposed between the bush 27 and the fixed scroll 13 via a radial bearing 29. The movable scroll 15 has a scroll plate 15*a* and a movable scroll wall 15*b*. The scroll plate 15*a* has a circular plate shape so as to extend in the radial direction of the scroll type compressor, and faces the base plate 13*a*. The movable scroll wall 15*b* is integrally formed with the scroll plate 15*a* and spirally extends forward from the scroll plate 15*a*. The movable scroll wall 15*b* engages with the fixed scroll wall 13*c*.

The shaft support member 11 cooperates with the movable scroll 15 to define a back pressure chamber 20. The plate 14 is formed in a ring shape and made of spring steel. The plate 14 is disposed between the shaft support member 11 and the movable scroll 15 in the back pressure chamber 20, and held by the shaft support member 11 and the shell 13*b* of the fixed scroll 13.

The movable scroll wall 15*b* has an inlet 61*a*, an outlet 61*b*, and a communication hole 61*c*. The inlet 61*a* opens at a front end face of the movable scroll wall 15*b* and is communicable with a compression chamber 31. The outlet 61*b* is formed on the scroll plate 15*a* and communicates with the back pressure chamber 20. The communication hole 61*c* that extends linearly in a direction of the central axis O provides communication between the inlet 61*a* and the outlet 61*b*. The inlet 61*a*, the outlet 61*b*, and the communication hole 61*c* configure a fluid supply passage 60.

A rear face of the scroll plate 15*a* is recessed, that is, a rotation preventing hole 17*b* is formed. An end portion of the rotation preventing pin 17*a* is loosely fitted to the rotation preventing hole 17*b*. There is also loosely fitted a cylindrical ring 17*c* to the rotation preventing hole 17*b*. The rotation preventing pin 17*a* slides and rolls on an inner peripheral surface of the ring 17*c*, so that the movable scroll 15 is supported so as to be prevented from rotating and allowed to revolve around the central axis O (revolution shaft) in the housing 16. The base plate 13*a*, the fixed scroll wall 13*c*, the scroll plate 15*a*, and the movable scroll wall 15*b* cooperate to define the compression chamber 31, that is, the movable scroll 15 cooperates with the fixed scroll 13 to define the compression chamber 31.

Referring to FIG. 1, the shaft support member 11 cooperates with the motor housing 3 to define a motor chamber 3*c*. The motor chamber 3*c*, which also serves as a suction chamber, is located on the rear side of the shaft support member 11 in the motor housing 3. The motor chamber 3*c* has therein a stator 33 and a rotor 35. The stator 33 is fixed to the motor chamber 3*c*. The rotor 35 is fixed to the rotary shaft 19 in the stator 33. When the rotor 35 and the rotary shaft 19 integrally rotate by energizing the stator 33, the driving force by rotation is transferred to the movable scroll 15 via the eccentric pin 19*a* and the bush 27 so that the movable scroll 15 revolves around the revolution shaft.

The motor housing 3 has a suction port 3*e* that provides communication between the motor chamber 3*c* and the outside of the motor chamber 3*c*. The suction port 3*e* is connected to an evaporator (not shown) with a pipe. In addition, the evaporator is connected to an expansion valve and a condenser with pipes. Refrigerant of low pressure and low temperature in the evaporator is introduced to the motor chamber 3*c* through the suction port 3*e*, and supplied to the compression chamber 31 through a suction passage (not shown) formed in the shaft support member 11.

The base plate 13*a* of the fixed scroll 13 cooperates with the front housing 1 to define a discharge chamber 37 therebetween. The base plate 13*a* has through the center thereof a discharge port 13*d* that provides communication between the compression chamber 31 and the discharge chamber 37. In addition, referring to FIG. 3, the base plate 13*a* has therethrough sub-ports 13*e*, 13*f* that are located away from the discharge port 13*d* to some extent and also provide communication between the compression chamber 31 and the discharge chamber 37.

Referring to FIG. 2, the front face of the flange portion 11*b* of the shaft support member 11 is recessed, that is, a guide groove 51 extending in the radial direction of the scroll type compressor is formed. The plate 14 is located in front of the guide groove 51 that communicates with the back pressure chamber 20. The plate 14 has in an outer peripheral side thereof a communication hole 53 that communicates with the guide groove 51. The shell 13*b* of the fixed scroll 13 has therethrough a relief hole 55 that communicates with the communication hole 53. The relief hole 55 extends in a direction of the central axis O in the shell 13*b* and bends toward the center of the scroll type compressor in the base plate 13*a*, as shown in FIG. 1. This bending provides communication between the relief hole 55 and the discharge chamber 37. The guide groove 51, the communication hole 53, and the relief hole 55 correspond to a relief passage 50 through which the back pressure chamber 20 and the discharge chamber 37 communicate with each other.

Figure 4:
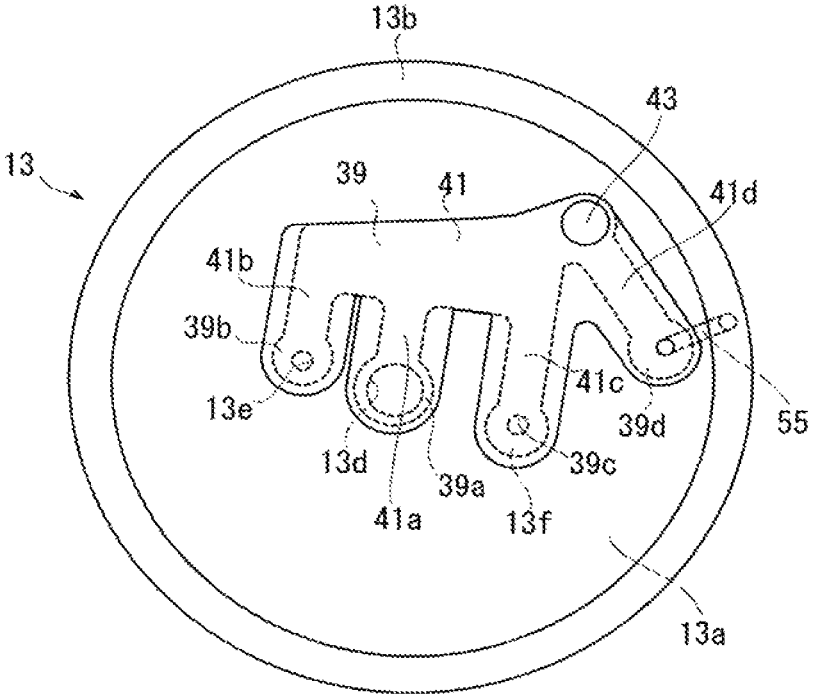
FIG. 4 is a plan view showing a back surface of the fixed scroll of the electric compressor according to the first embodiment.

The base plate 13*a* has a reed valve 39 that deforms elastically and a retainer 41 configured to restrict amount of deformation of the reed valve 39. Referring to FIG. 4, the reed valve 39 and the retainer 41 is fixed to the base plate 13*a* by a bolt 43.

The reed valve 39 is integrally configured of a discharge valve portion 39*a* to open and close the discharge port 13*d*, a sub-valve portion 39*b* to open and close the sub-port 13*e*, a sub-valve portion 39*c* to open and close the sub-port 13*f*, and a check valve portion 39*d* to open, and close the relief hole 55. The discharge valve portion 39*a* corresponds to the discharge valve in the present disclosure. The check valve portion 39*d* corresponds to the check valve in the present disclosure.

The retainer 41 is also integrally configured of a discharge retainer portion 41*a* that is configured to restrict amounts of deformation of the discharge valve portion 39*a*, a sub-retainer portion 41*b* that is configured to restrict amounts of deformation of the sub-valve portion 39*b*, a sub-retainer portion 41*c* that is configured to restrict amounts of deformation of the sub-valve portion 39*c*, and a check valve retainer portion 41*d* that is configured to restrict amounts of deformation of the check valve portion 39*d*. The discharge retainer portion 41*a* and the check valve retainer portion 41*d* correspond to the discharge valve retainer and the check valve retainer in the present disclosure, respectively. In other words, the base plate 13*a* has the discharge valve portion 39*a*, the discharge retainer portion 41*a*, the check valve portion 39*d*, and the check valve retainer portion 41*d*. The discharge valve portion 39*a* has a plate shape, is located in the discharge chamber 37, and opens and closes the discharge port 13*d* by elastic deformation. The check valve portion 39*d* has a plate shape, and opens and closes an opening of a relief passage 50 near the discharge chamber 37 by elastic deformation.

Referring to FIG. 1, the front housing 1 has therethrough a discharge port 1*a* that provides communication between the outside of the front housing 1 and the discharge chamber 37. The discharge port 1*a* is connected to a condenser (not shown) with a pipe. The refrigerant introduced into the discharge chamber 37 is discharged to the condenser through the discharge port 1*a*.

The compression mechanism 10 is configured of the motor chamber 3*c*, the rotary shaft 19, the bush 27, the radial bearing 29, the movable scroll 15, the fixed scroll 13, the discharge chamber 37, the reed valve 39, the retainer 41, and the like to compress the refrigerant. The compression mechanism 10 may also include an oil separator disposed in the discharge chamber 37. The compression mechanism 10 is driven by the motor mechanism 12 including the rotor 35, the stator 33, and the rotary shaft 19. Three-phase alternating current is supplied to the motor mechanism 12 by an inverter (not shown).

The electric compressor having the configuration described above cooperates with the evaporator, the expansion valve, and the condenser to configure a refrigerating circuit of an air conditioning device for a vehicle. This electric compressor operates as follows. When an operator of a vehicle operates an air conditioning device for a vehicle, an inverter rotates the rotor 35 and the rotary shaft 19 having the eccentric pin 19*a* by controlling the motor mechanism 12. The eccentric pin 19*a* is rotated around the central axis O. While the eccentric in 19*a* is rotated around the central axis O, the rotation preventing pin 17*a* slides and rolls on the inner peripheral surface of the ring 17*c*, so that the movable scroll 15 is prevented from rotating and allowed to revolve around the central axis O. The compression chamber 31 is moved radially inward from an outer peripheral side of both scrolls 13, 15 by revolution of the movable scroll 15 while the compression chamber 31 reduces its volume. Refrigerant supplied from the evaporator to the motor chamber 3*c* through the suction port 3*e* is sucked to the compression chamber 31 and compressed for the movement of the compression chamber 31. When pressure of the refrigerant compressed in the compression chamber 31 reaches discharge pressure, the refrigerant moves through the discharge port 13*d*, opens the discharge valve portion 39*a* of the reed valve 39, and then is discharged to the discharge chamber 37. The discharge retainer portion 41*a* of the retainer 41 is configured to restrict amount of deformation of the discharge valve portion 39*a*. Finally, the refrigerant of high pressure is discharged to the condenser through the discharge port 1*a*, so that air conditioning is performed by air conditioning device for a vehicle.

While air conditioning is performed, the inlet 61*a* communicates with the compression chamber 31, that is, the fluid supply passage 60 provides communication between the compression chamber 31 and the back pressure chamber 20 by elastic deformation or movement in the direction of the central axis O of the movable scroll 15. Refrigerant gas of high pressure in the compression chamber 31 is supplied to the back pressure chamber 20. The back pressure of the back pressure chamber 20 is increased, urging the movable scroll 15 toward the fixed scroll 13. This may achieve high compression efficiency of the scroll type compressor. The refrigerant gas corresponds to the fluid in the present disclosure.

When liquid refrigerant and lubrication oil increases in the compression chamber 31, the liquid refrigerant and the lubrication oil opens the sub-valve portions 39*b*, 39*c* of the reed valve 39 through the sub-ports 13*e*, 13*f*, and are discharged to the discharge chamber 37. The sub-retainer portions 41*b*, 41*c* to of the retainer 41 are configured to restrict amounts of deformation of the sub-valve portions 39*b*, 39*c*. Furthermore, the liquid refrigerant and the lubrication oil in the compression chamber 31 is moved to the back pressure chamber 20 through the fluid supply passage 60. These configurations prevent impacts generated by increasing pressure of the liquid.

Figure 5:
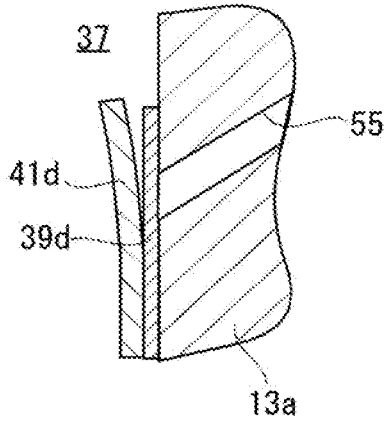
FIG. 5 is a cross-sectional view showing a main section of the fixed scroll and the like of the electric compressor according to the first embodiment.

When back pressure of the back pressure chamber 20 is higher than discharge pressure of the discharge chamber 37, the refrigerant in the back pressure chamber 20 opens the check valve portion 39*d* of the reed valve 39 though the guide groove 51, the communication hole 53, and the relief hole 55, and is discharged to the discharge chamber 37, as shown in FIG. 5. In other words, the check valve portion 39*d* of the reed valve 39 that allows the refrigerant to flow from the back pressure chamber 20 to the discharge chamber 37 in a state described above is disposed in the relief passage 50. The check valve retainer portion 41*d* of the retainer 41 is configured to restrict amount of deformation of the check valve portion 39*d*. The refrigerant gas of higher pressure in the back pressure chamber 20 than the discharge pressure flows into the discharge chamber 37 through the fluid supply passage 60. This reduces the excessive urging of the movable scroll 15 by excessively high back pressure, preventing wear of the movable scroll 15.

In this compression process, the refrigerant gas in the back pressure chamber 20 does not flow into the motor chamber 3*c*. This means that the compressed refrigerant gas is not sucked into the compression chamber 31 and compressed again. When back pressure of the back pressure chamber 20 is lower than discharge pressure of the discharge chamber 37, the check valve portion 39*d* of the reed valve 39 closes the relief hole 55. The refrigerant gas in the back pressure chamber 20 remains in the back pressure chamber 20, appropriately urging the movable scroll 15 toward the fixed scroll 13. This may achieve high compression efficiency of the scroll type compressor.

Therefore, this electric compressor prevents wear and the like of the movable scroll 15 by excessively high back pressure while reducing power loss.

In this electric compressor, at least a part of the relief passage 50 extends through the shell 13*b* of the fixed scroll 13. The shell 13*b* is formed so as to have a sufficient thickness because the shell 13*b* requires high stiffness to prevent the base plate 13*a* and the fixed scroll wall 13*c* from being distorted, so that the relief hole 55 providing communication between the back pressure chamber 20 and the discharge chamber 37 is easily formed in the shell 13*b*, and the shell 13*b* is not easily distorted when fluid of high pressure flows through the relief hole 55. In addition, the relief passage 50 easily provides communication between the back pressure chamber 20 and the discharge chamber 37, lowering cost of the electric compressor.

In this electric compressor, the reed valve 39 and the retainer 41 integrally have a check valve portion 39*d* and the check valve retainer portion 41*d*, respectively. With this configuration, no additional check valves and retainers are required other than the existing discharge valve and retainer that open and close the discharge port 13*d* and the sub-valve portions 39*b* and 39*c*, so that the number of parts of the electric compressor is reduced. Reducing the number of parts also lowers the cost of the electric compressor.

In this electric compressor, the plate 14, which urges the movable scroll 15 toward the fixed scroll 13 by its own spring characteristics and back pressure, is disposed between the shaft support member 11 and the movable scroll 15, and the plate 14 has therethrough the communication hole 53 that is a part of the relief passage 50. This achieves addition of the relief passage 50 while an advantage of using the plate 14 is ensured.

(Second Embodiment)

Figure 6:
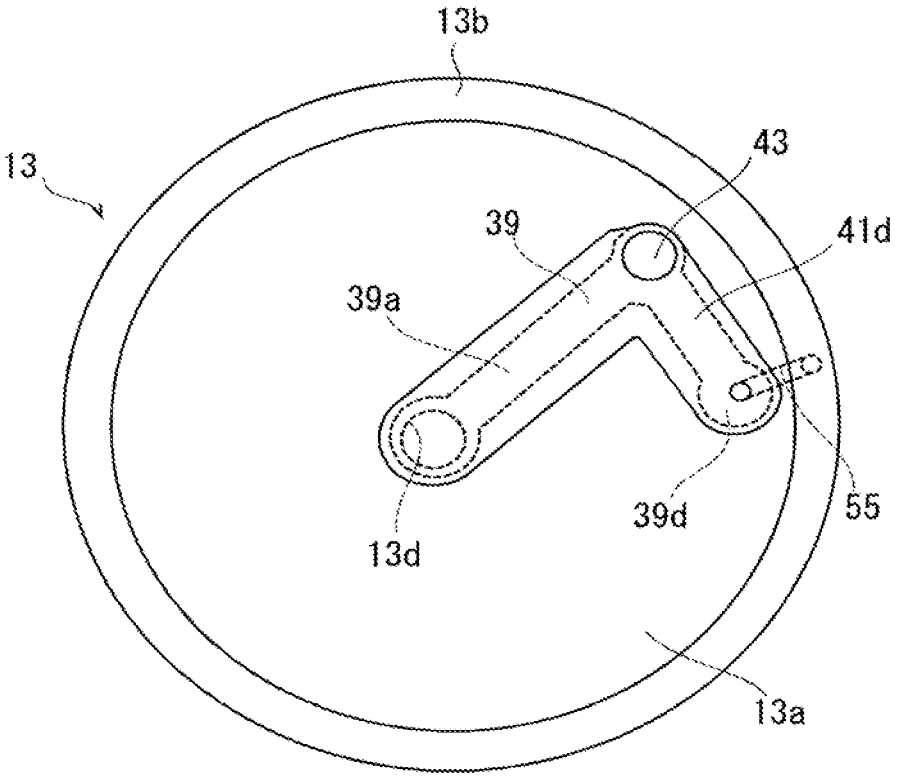
FIG. 6 is a plan view showing a back surface of a fixed scroll of an electric compressor according to a second embodiment of the present disclosure.

Referring to FIG. 6, in an electric compressor of a second embodiment, the base plate 13*a* does not have such sub-ports 13*e*, 13*f* as those described in the first embodiment. This means that the reed valve 39 of the second embodiment also does not have such sub-valve portions 39*b*, 39*c* as those of the first embodiment. The retainer 41 also does not have such sub-retainer portions 41*b*, 41*c* as those of the first embodiment. The other configurations of the second embodiment are the same as those of the first embodiment. Therefore, identical configurations have the same reference numerals, and a detail description of the configurations is omitted.

In this electric compressor, liquid refrigerant and lubrication oil in the compression chamber 31 is moved to the back pressure chamber 20 through the fluid supply passage 60. The relief passage 50 serves a function as a sub-port through which the liquid refrigerant is discharged, preventing impacts generated by increasing pressure of the liquid, so that sub-ports 13*e*, 13*f* may be reduced or eliminated. Reducing or eliminating the sub-ports achieves high volume efficiency by reducing dead volume and lowers manufacturing cost of the electric compressor by reducing working man hours. The other advantageous effects are the same as those of the first embodiment.

(Third Embodiment)

Figure 7:
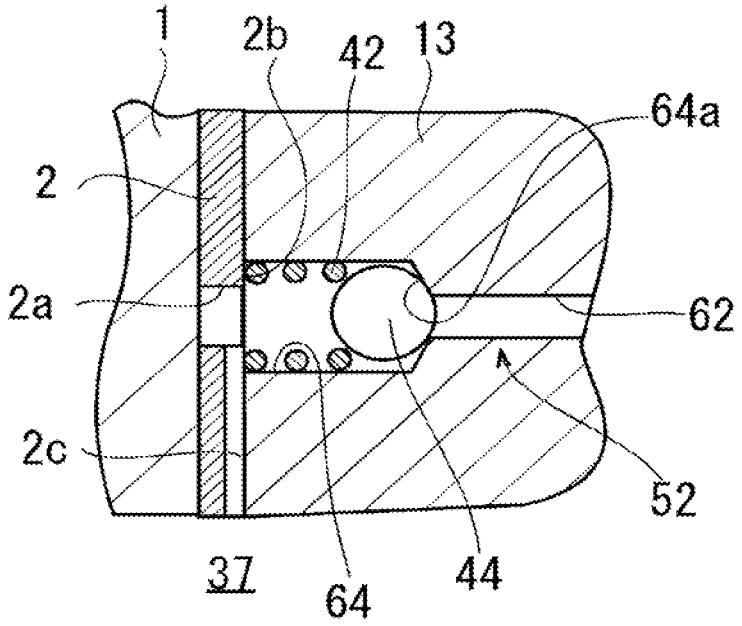
FIG. 7 is a cross-sectional view showing a main section of a fixed scroll and the like of an electric compressor according to a third embodiment of the present disclosure.

Referring to FIG. 7, a relief hole 62 communicating with the back pressure chamber 20 and a valve chamber 64 communicating with the relief hole 62 are formed in the fixed scroll 13 in an electric compressor of a third embodiment. A portion of the valve chamber 64 around the relief hole 62 is a valve seat 64*a*. The valve chamber 64 is covered by the gasket 2 having an opening 2*a*. The gasket 2 has a spring washer 2*b* around the opening 2*a* of the gasket 2. The opening 2*a* and the valve chamber 64 communicate with the discharge chamber 37 via a recessed groove 2*c* formed by recessing the gasket 2.

A ball 44 as the check valve in the present disclosure is disposed on the valve seat 64*a* side in the valve chamber 64. An urge spring 42 is disposed between the ball 44 and the spring washer 2*b*. The relief hole 62, the valve chamber 64, the opening 2*a*, and the recessed groove 2*c* correspond to a relief passage 52. The other configurations of the third embodiment are the same as those of the first embodiment. Therefore, identical configurations have the same reference numerals, and a detail description of the configurations is omitted.

In this electric compressor, when back pressure of the back pressure chamber 20 is higher than discharge pressure of the discharge chamber 37, refrigerant in the back pressure chamber 20 passes through the relief hole 62 and presses the ball 44 so as to be distanced away from the valve seat 64*a*, so that the refrigerant is discharged to the discharge chamber 37 through the valve chamber 64, the opening 2*a*, and the recessed groove 2*c*. When back pressure of the back pressure chamber 20 is lower than discharge pressure of the discharge chamber 37, the ball 44 is seated on the valve seat 64*a*, so that the refrigerant in the back pressure chamber 20 remains in the back pressure chamber. The other advantageous effects are the same as those of the first embodiment and the second embodiment.

(Fourth Embodiment)

Figure 8:
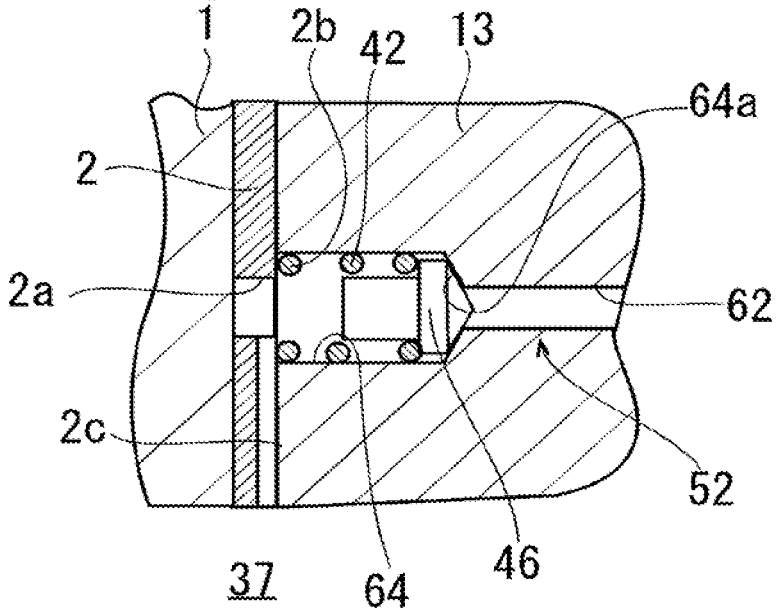
FIG. 8 is a cross-sectional view showing a main section of a fixed scroll and the like of an electric compressor according to a fourth embodiment of the present disclosure.

In an electric compressor of a fourth embodiment, the check valve is provided not by a ball but by a spool valve 46, as shown in FIG. 8. The spool valve 46 on the valve seat 64*a* side is formed in an umbrella shape. The other configurations of the fourth embodiment are the same as those of the third embodiment. Therefore, identical configurations have the same reference numerals, and the detail description of the configurations is omitted.

This electric compressor has the same advantageous effects as those of the third embodiment.

The present disclosure is described above in accordance with the first to the fourth embodiment. However, the present disclosure is not limited to the first to the fourth embodiments, and may be appropriately modified within the gist of the disclosure.

For example, although fluid of high pressure in the compression chamber 31 is supplied to the back pressure chamber 20 through the fluid supply passage 60 formed in the movable scroll 15 in the first to the fourth embodiment, fluid of high pressure in the compression chamber 31 may be supplied to the back pressure chamber 20 by providing communication between the discharge chamber 37 and the back pressure chamber 20.

The present disclosure is not limited to the scroll type compressor that includes the shaft support member accommodated in the housing. The scroll type compressor may include the shaft support member held by the housing configured of two parts.

Furthermore, the present disclosure is not limited to an electric compressor, and may be a scroll type compressor driven by an engine or a motor of a vehicle.

The present disclosure may be applied to conditioning device for a vehicle and the like.

What is claimed is:

1. A scroll type compressor comprising:

a housing;

a fixed scroll fixed to the housing, and cooperating with the housing to define a discharge chamber;

a movable scroll supported so as to be allowed to revolve around a revolution shaft in the housing, and cooperating with the fixed scroll to define a compression chamber; and a shaft support member fixed to the housing, cooperating with the movable scroll to define a back pressure chamber, and cooperating with the housing to define a suction chamber, wherein the fixed scroll has a base plate and a fixed scroll wall integrally formed with the base plate, wherein the movable scroll has a scroll plate facing the base plate and a movable scroll wall integrally formed with the scroll plate and engaging with the fixed scroll wall, and wherein fluid in the compression chamber is supplied to the back pressure chamber, wherein the back pressure chamber and the discharge chamber communicate with each other through a relief passage, the back pressure chamber is disposed on a side opposite to the discharge pressure chamber with respect to the compression chamber interposed between the back pressure chamber and the discharge chamber, and the relief passage is disposed radially outward of the compression chamber, a check valve is disposed in the relief passage, wherein when back pressure of the back pressure chamber is higher than discharge pressure of the discharge chamber, the check valve allows the fluid to flow from the back pressure chamber to the discharge chamber, and when the back pressure of the back pressure chamber is lower than the discharge pressure of the discharge chamber, the check valve is closed.

2. The scroll type compressor according to claim 1, wherein the fixed scroll has a shell formed so as to surround the fixed scroll wall and joined to the housing, and at least a part of the relief passage extends through the shell.

3. The scroll type compressor according to claim 1, wherein the base plate of the fixed scroll has a discharge port that provides communication between the compression chamber and the discharge chamber, the check valve has a plate shape, and opens and closes an opening of the relief passage near the discharge chamber by elastic deformation, the base plate of the fixed scroll has:

a discharge valve that has a plate shape, is located in the discharge chamber, and opens and closes the discharge port by elastic deformation;

a discharge retainer that is configured to restrict amount of deformation of the discharge valve; the check valve; and a check valve retainer that is configured to restrict amount of deformation of the check valve, the discharge valve and the check valve are integrally formed, and the discharge valve retainer and the check valve retainer are integrally formed.

4. The scroll type compressor according to claim 1, wherein the movable scroll includes a fluid supply passage having:

an inlet that opens at a front end face of the movable scroll wall, and is communicable with the compression chamber;

an outlet that is formed on the scroll plate and communicates with the back pressure chamber; and a communication hole that provides communication between the inlet and the outlet, and the fluid supply passage provides communication between the compression chamber and the back pressure chamber by elastic deformation or movement in a direction of the revolution shaft of the movable scroll.

5. The scroll type compressor according to claim 1, wherein a plate, which urges the movable scroll toward the fixed scroll by its own spring characteristics and the back pressure, is disposed between the shaft support member and the movable scroll, and the plate has therethrough a part of the relief passage.

6. The scroll type compressor according to claim 5, wherein the relief passage includes: a guide groove that is formed in a front face of a flange portion of the shaft support member and extends in a radial direction of the scroll type compressor, a communication hole that is formed on an outer peripheral side of the plate and communicates with the guide groove, and a relief hole that is formed through a shell of the fixed scroll and communicates with the communication hole.

* * * * *